United States Patent [19]

Comber

[11] Patent Number: 4,628,902

[45] Date of Patent: Dec. 16, 1986

[54] HOT WATER DISTRIBUTION SYSTEM

[76] Inventor: Cornelius J. Comber, 383 El Greco Dr., Osprey, Fla. 33559

[21] Appl. No.: 740,880

[22] Filed: Jun. 3, 1985

[51] Int. Cl.[4] ..... F24H 1/00

[52] U.S. Cl. ..... 126/362; 417/12

[58] Field of Search ..... 126/362, 387, 350 R; 237/19; 417/12; 122/17

[56] References Cited

U.S. PATENT DOCUMENTS

| | | | |
|---|---|---|---|
| 1,730,736 | 10/1929 | Knudsen . | |
| 2,007,872 | 7/1935 | Oliphant . | |
| 2,233,050 | 2/1941 | Groeniger . | |
| 3,096,021 | 7/1963 | Lintvedt . | |
| 3,111,942 | 11/1963 | Miller . | |
| 3,383,495 | 5/1968 | Laube et al. . | |
| 3,941,118 | 3/1976 | Schutte | 126/362 |
| 4,201,518 | 5/1980 | Stevenson . | |
| 4,321,943 | 3/1982 | Haws . | |

*Primary Examiner*—Henry Bennett

*Attorney, Agent, or Firm*—Hauke and Patalidis

[57] ABSTRACT

A hot water distribution system for providing almost instantaneous supply of hot water at a hot water usage outlet. The system of the invention comprises a closed loop and a pump circulating hot water in the closed loop from a supply of hot water and back to the supply of hot water. One or more usage outlets are connected to the closed loop each by a relatively short length of pipe. A one-way check valve prevents drawing water from the return line of the closed loop. Heat insulation of the closed loop is provided to prevent unnecessary heat losses, and a thermally operated switch may be used to control the operation of the closed loop circulation pump to maintain the water in the closed loop at a predetermined temperature.

8 Claims, 4 Drawing Figures

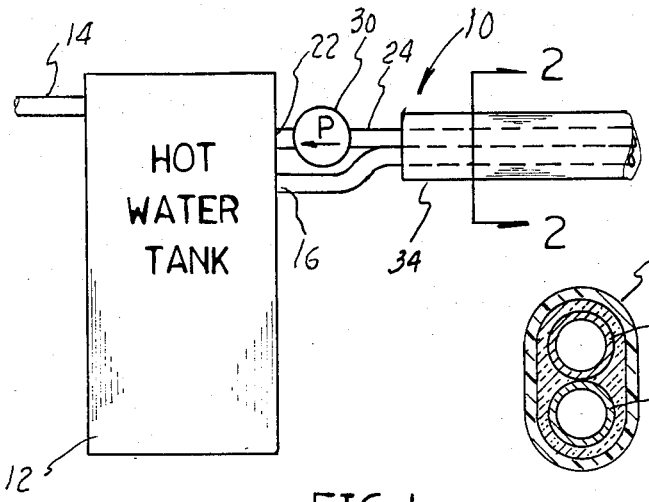
FIG. 1
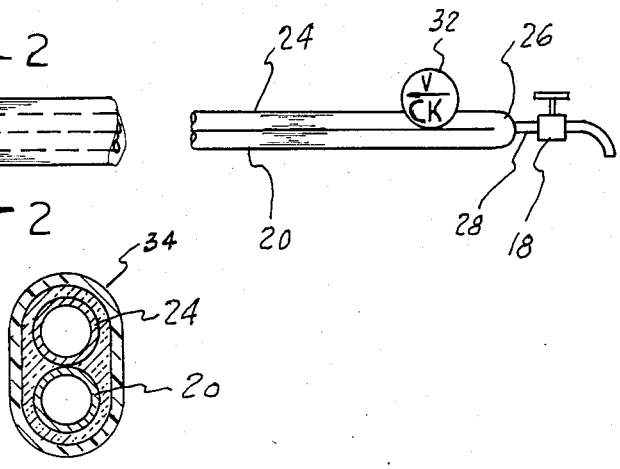
FIG. 2
FIG. 3
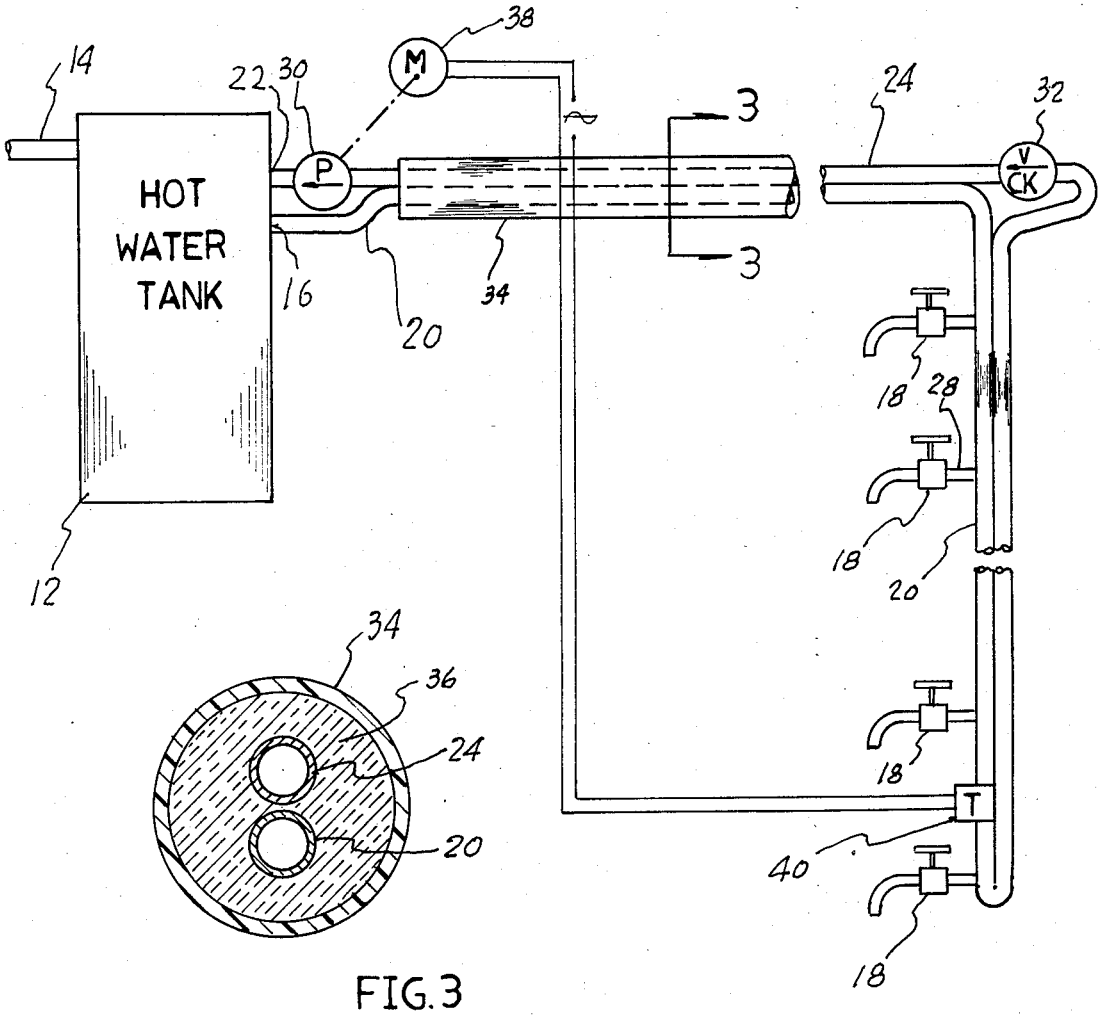
FIG. 4

HOT WATER DISTRIBUTION SYSTEM

BACKGROUND OF THE INVENTION

The present invention relates to a hot water distribution system in general, and more particularly to a system providing an almost instantaneous supply of hot water on demand.

One of the problems associated with hot water distribution systems of conventional design is that associated with the requirement of drawing water, for example from a hot water faucet, for a relatively long period of time prior to obtaining at the faucet outlet water at the desired temperature. This is due to the fact that the water heater and hot water tank, generally combined in a single unit, may be located at a considerable distance from a hot water faucet or to an apparatus utilizing hot water such as, for example, a clothes washer, a dish washer or the like. Attempts have been made in the past to insulate hot water conduits and pipes from the ambient by wrapping the pipes and conduits with a heat insulation material. Nevertheless, more particularly when there is only an occasional demand for hot water, the conduits and pipes and the stagnant water in the conduits and pipes rapidly cool to a temperature close to ambient temperature. When there is a sudden demand for hot water, wasted water must be allowed to flow from the faucet until the colder water in the supply pipe is exhausted. When the momentary demand for hot water is from a hot water usage apparatus, such as a clothes washer or dishwasher permanently connected to the hot water supply, the stagnant water in the supply pipe may be a temperature too low to accomplish the desired results in the most efficient manner. Hot water faucets, which require that they be open long enough to purge from the supply conduits or pipes the residual water having cooled down to ambient temperature, lead to excessive loss of water and to an increase in the cost of the energy required for maintaining the water at a required temperature in the water heater hot water tank.

The disadvantages of conventional hot water supply systems for dwelling houses, apartment buildings, offices, manufacturing plants are more particularly important in the northern latitudes where ambient temperatures may drop far below freezing during the winter, where long conduits or pipes are used from a centrally located hot water tank to various remote locations of the building. The heat losses may be such that it is not uncommon for hot water pipes to freeze.

SUMMARY OF THE INVENTION

The present invention remedies the inconveniences of the prior art in hot water supply systems and has for its principal object to provide an almost instantaneous supply of hot water where and when needed, irrespective of the distance separating a hot water tank or water heater from the location where there is a requirement for hot water.

The objects and advantages of the present invention will become apparent to those skilled in the art when the following description of examples of structure representing the best modes contemplated at the present for practicing the invention is read in conjunction with the accompanying drawing wherein like reference numerals refer to like or equivalent parts, and in which:

BRIEF DESCRIPTION OF THE DRAWING

FIG. 1 is a schematic representation of an example of structure for a hot water supply system according to the present invention;

FIG. 2 is a section along line 2—2 of FIG. 1;

FIG. 3 is a view similar to FIG. 2, and showing a modification thereof; and

FIG. 4 is a schematic view similar to FIG. 1, showing a modification thereof.

DETAILED DESCRIPTION OF THE PREFERRED EMBODIMENTS

Referring to the drawing, and more particularly to FIG. 1, there is illustrated, schematically, a hot water system 10 comprising a supply of hot water taking the form of a hot water tank 12, for example a combination hot water tank and water heater. Cold water is supplied to the hot water tank 12 by an inlet pipe 14 when hot water is drawn from the tank at its hot water outlet 16, for example by turning on a faucet 18 connected to the hot water outlet 16 via a conduit or pipe 20. The hot water tank and water heater 12 is conventional, and the water stored in the tank is heated by any conventional means such as, for example, an electrical heating means, a gas burner or an oil burner, not shown.

The hot water tank 12 is provided with an inlet 22 connected by a pipe 24 to the end of the hot water supply pipe 20 by way of an elbow section 26, the faucet 18 being connected to the elbow 26 through a length of pipe 28 as short as convenient. An electrically driven suction pump 30 is connected in the pipe 24, conveniently proximate the return inlet 22 into the hot water tank 12, and a one-way valve 32 is also connected at some convenient location along the pipe 24 to allow circulation of water in one direction only through the closed loop consisting of the hot water pipe 20, the elbow 26 and the return pipe 24 to the return inlet 22 to the hot water tank 12, when the pump 30 is activated. By circulating the hot water through the closed loop circuit, occasionally or constantly, the water circulating in the pipe 20 is maintained at a relatively high temperature, such that when the faucet 18 is turned on hot water is immediately supplied at the outlet of the faucet 18, the only portion of relatively luke warm or cold water being that contained in the short length of pipe 28 between the faucet 18 and the elbow connector 26. The check valve 32 prevents water in the return pipe 24, which may be at a lower temperature than the water in the hot water supply pipe 20, from being drawn through the faucet 18. The hot water supply pipe 20 and the return pipe 24 are preferably disposed adjoining one another and in engagement with each other, and are preferably surrounded by a sleeve 34 of heat insulating material for limiting heat convection from the pipes 20 and 24 to the ambient, FIGS. 1 and 2. Alternatively, and as illustrated at FIG. 3, the pipes 20 and 24 may be placed in an insulating conduit 34 of relatively large diameter, which may be made of metal or, preferably, plastic. Heat insulation may also be provided around the short length of pipe 28. An appropriate filler 36 made of a heat insulating material such as, for example, asbestos or ceramics, fills the void between the internal surface of the sleeve or conduit 34 and the peripheral surface of the pipes 20 and 24. Appropriate support brackets, not shown, may be used for holding the pipes 20 and 24 within the conduit 34.

FIG. 4 schematically represents an arrangement for supplying hot water from the hot water tank 12 to a plurality of hot water outlets symbolically represented by faucets 18. It will be appreciated by those skilled in the art that the outlets of hot water may be other than faucets, and may consist of appropriate connectors for hot water inlets to usage apparatus utilizing hot water, such as dishwashers, clothes washers, hot and cold water mixing faucets, shower heads and hot tubs, spas and the like. The piping arrangement is similar to that of FIG. 1, and consists essentially of a hot water supply line or pipe 20 preferably juxtaposed with a return line or pipe 24, a pump 30 being adapted to circulate hot water through the twin pipes 20 and 24 when driven by an electric motor 38. A thermostat-actuated switch 40 is attached in some appropriate location to the hot water pipe 20 to sense the temperature of the water in the pipe 20 and start the operation of the motor 38 driving the pump 30 when the temperature in the pipe 20 drops below a predetermined threshold value. When the temperature in the hot water supply pipe 20 reaches an upper preset limit, corresponding to a desirable hot water supply temperature, the operation of the circulation pump 30 is interrupted by the thermostat-actuated switch 40 switching off the drive motor 38. As the temperature of the water in the hot water supply pipe 20 is constantly maintained at a desirable temperature, hot water is almost instantaneously supplied to any one of the faucets 18, or other hot water usage outlets, when required. Although not shown at FIG. 4, the twin pipes 20 and 24 are preferably thermally insulated from the ambient by any appropriate convenient means, such as illustrated at FIGS. 2 and 3 for example.

Having thus disclosed the present invention by examples of structure well designed to accomplish the objects of the invention, modifications whereof will be apparent to those skilled in the art, what is claimed as new is as follows:

1. A hot water distribution system comprising a supply of hot water, a hot water circulation closed loop formed by a first pipe connected to an outlet of said supply of hot water and a return pipe connected to a return inlet of said supply of hot water, means for circulating hot water through said closed loop from said outlet to said return inlet, a hot water usage outlet connected by a substantially short line to said closed loop, and a one-way check valve connected in said loop for preventing water from being drawn from said return pipe upon dispensing hot water through said usage outlet, wherein said first pipe and said return pipe are disposed adjoining each other.

2. The hot water distribution system of claim 1 wherein said means for circulating hot water in said loop is a suction pump disposed proximate said return inlet to said supply of hot water.

3. The hot water distribution system of claim 1 further comprising heat insulation means disposed around the pipes of said closed loop.

4. The hot water distribution system of claim 2 further comprising heat insulation means disposed around the pipes of said closed loop.

5. The hot water distribution system of claim 1 further comprising a temperature-sensitive electrical switch operable at a predetermined temperature of the water in said closed loop for controllably starting said means for circulating hot water in said closed loop to an operative mode upon the temperature of the water in said closed loop falling below a predetermined threshold value.

6. The hot water distribution system of claim 2 further comprising a temperature-sensitive electrical switch operable at a predetermined temperature of the water in said closed loop for controllably starting said pump to an operative mode upon the temperature of the water in said closed loop falling below a predetermined threshold value.

7. The hot water distribution system of claim 3 further comprising a temperature-sensitive electrical switch operable at a predetermined temperature of the water in said closed loop for controllably starting said means for circulating hot water in said closed loop to an operative mode upon the temperature of the water in said closed loop falling below a predetermined threshold value.

8. The hot water distribution system of claim 4 further comprising a temperature-sensitive electrical switch operable at a predetermined temperature of the water in said closed loop for controllably starting said pump to an operative mode upon the temperature of the water in said closed loop falling below a predetermined threshold value.

* * * * *